US010905200B2

(12) United States Patent
Blanchard

(10) Patent No.: US 10,905,200 B2
(45) Date of Patent: Feb. 2, 2021

(54) FOOTWEAR COMPONENT MANUFACTURING FIXTURE

(71) Applicant: NIKE, Inc., Beaverton, OR (US)

(72) Inventor: Philippe Blanchard, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 996 days.

(21) Appl. No.: 15/365,374

(22) Filed: Nov. 30, 2016

(65) Prior Publication Data

US 2017/0181502 A1 Jun. 29, 2017

Related U.S. Application Data

(60) Provisional application No. 62/272,520, filed on Dec. 29, 2015.

(51) Int. Cl.

| | |
|---|---|
| ***A43D 5/02*** | (2006.01) |
| ***A43D 8/36*** | (2006.01) |
| ***A43D 8/32*** | (2006.01) |
| ***A43D 8/02*** | (2006.01) |
| ***A43D 95/14*** | (2006.01) |
| ***A43D 95/24*** | (2006.01) |

(52) U.S. Cl.

CPC ..... *A43D 5/02* (2013.01); *A43D 8/02* (2013.01); *A43D 8/32* (2013.01); *A43D 8/36* (2013.01); *A43D 95/14* (2013.01); *A43D 95/24* (2013.01)

(58) Field of Classification Search

CPC ..... A43D 5/02; A43D 8/02; A43D 8/06
USPC ..... 12/107 R, 108, 111, 115.8, 116.2, 117.2
See application file for complete search history.

(56) References Cited

U.S. PATENT DOCUMENTS

| | | | | |
|---|---|---|---|---|
| 1,573,045 A * | 2/1926 | Durrance | ..... | A43D 5/02 12/123 |
| 1,695,321 A * | 12/1928 | Conner | ..... | A43D 5/02 12/42 B |
| 1,710,718 A * | 4/1929 | Stotz | ..... | A43D 5/02 269/156 |

(Continued)

FOREIGN PATENT DOCUMENTS

| | | |
|---|---|---|
| CN | 2410899 Y | 12/2000 |
| CN | 203988539 U | 12/2014 |

(Continued)

OTHER PUBLICATIONS

International Search Report and Written Opinion dated Apr. 24, 2017 in International Patent Application No. PCT/US2016/069163, 16 pages.

(Continued)

*Primary Examiner* — Ted Kavanaugh
(74) *Attorney, Agent, or Firm* — Shook, Hardy & Bacon LLP

(57) ABSTRACT

A footwear component manufacturing fixture secures a component, such as a shoe sole, in a manner that allows for the processing of one or more surfaces of the component without obscuring the surfaces. The fixture has a fixed portion with a first compression surface and an adjustable portion having a second compression surface. The adjustable portion moves in relation to the fixed portion to compress one or more protrusions of the component between the compression surfaces to secure the component to the fixture for processing.

16 Claims, 7 Drawing Sheets

(56) References Cited

U.S. PATENT DOCUMENTS 1,724,355 A * 8/1929 Kutscher ..... A43D 5/02 12/125
1,820,492 A * 8/1931 Rattazzi ..... A43D 5/02 12/125
1,837,728 A * 12/1931 Rattazzi ..... A43D 5/02 12/125
1,854,591 A * 4/1932 Leddy ..... A43D 5/02 12/123
1,855,787 A * 4/1932 Ashton ..... A43D 5/02 12/126
1,907,607 A * 5/1933 Strobel ..... A43D 5/02 12/123
1,922,750 A * 8/1933 Salcaian ..... A43D 5/02 12/123
1,928,847 A * 10/1933 Bates ..... A43D 5/02 12/125
1,954,178 A * 4/1934 Kakides ..... A43D 5/02 12/126
1,991,462 A * 2/1935 Lawson ..... A43D 5/02 12/124
2,035,549 A * 3/1936 Turner ..... A43D 5/02 12/123
2,145,311 A * 1/1939 Lioy ..... A43D 5/02 12/127
2,191,230 A * 2/1940 Guss ..... A43D 5/00 12/1 R
2,892,200 A * 6/1959 Davis ..... A43D 5/02 12/123.3
4,909,768 A * 3/1990 O'Brien ..... B63B 32/35 441/70
5,098,508 A * 3/1992 Mattil ..... A43D 5/02 12/122
5,701,685 A * 12/1997 Pezza ..... A43B 13/18 36/27
5,875,504 A * 3/1999 Tambling ..... A43D 3/1458 12/114.2
6,393,736 B1 * 5/2002 Greer, Jr. ..... A61F 5/14 36/145
6,438,872 B1 * 8/2002 Chil ..... A43B 1/0072 36/102
8,397,402 B2 * 3/2013 Lucas ..... A43B 3/0042 36/102
2011/0047826 A1 * 3/2011 Rosen ..... A43B 3/14 36/97
2013/0014330 A1 * 1/2013 Romero ..... A43D 5/02 12/123
2013/0318805 A1 * 12/2013 Aoki ..... B62M 3/086 33/515
2013/0333124 A1 * 12/2013 Okamoto ..... A43B 5/14 12/123
2014/0237738 A1 * 8/2014 Johnson ..... B29D 35/126 12/107 R
2015/0208765 A1 7/2015 Spampinato
2016/0150856 A1 6/2016 Regan et al.

FOREIGN PATENT DOCUMENTS

| | | | |
|---|---|---|---|
| EP | 0605485 | A1 | 7/1994 |
| EP | 1125514 | A2 | 8/2001 |
| GB | 558340 | A | 12/1943 |
| JP | 2016-55153 | A | 4/2016 |
| KR | 101177870 | B1 | 8/2012 |
| WO | 9305675 | A1 | 4/1993 |
| WO | 2013024498 | A1 | 2/2013 |
| WO | 2015025398 | A1 | 2/2015 |

OTHER PUBLICATIONS

Office Action received for European Patent Application No. 16826659.1, dated May 25, 2020, 6 pages.

* cited by examiner

FOOTWEAR COMPONENT MANUFACTURING FIXTURE

CROSS-REFERENCE TO RELATED APPLICATIONS

This application having Ser. No. 15/365,374 and entitled "Footwear Component Manufacturing Fixture" claims the benefit of U.S. Provisional Application No. 62/272,520, entitled "Footwear Component Manufacturing Fixture," and filed Dec. 29, 2015. The entirety of the aforementioned application is incorporated by reference herein.

TECHNICAL FIELD

Aspects provide a fixture and use of the fixture in the manufacture of footwear components.

BACKGROUND

Footwear, such as a shoe, sandal, boot, and the like may be comprised of a bottom unit. A bottom unit may be a sole structure, which may be intended to engage the ground when worn by a user. Various surfaces of the bottom unit, such as a ground-contacting surface and a sidewall surface, may have processes performed thereon. The processes may include painting, cutting, siping, buffing, scanning, punching, embossing, and/or the like.

BRIEF SUMMARY

Aspects hereof provide a footwear component manufacturing fixture and the use thereof. The fixture is comprised of a fixed portion having a first compression surface and an adjustable portion having a second compression surface. The adjustable portion is moveably coupled to the fixed portion between at least a maintaining position and a receiving position. The first compression surface is closer in proximity to the second compression surface in the maintaining position than when in the receiving position. The fixture is further comprised of an adjustment mechanisms extending between the fixed portion and the adjustable portion. The adjustment mechanism provides, in part, the moveable coupling between the fixed portion and the adjustable portion.

This summary is provided to enlighten and not limit the scope of methods and systems provided hereafter in complete detail.

DESCRIPTION OF THE DRAWINGS

The present invention is described in detail herein with reference to the attached drawing figures, wherein.

DETAILED DESCRIPTION

Figure 1:
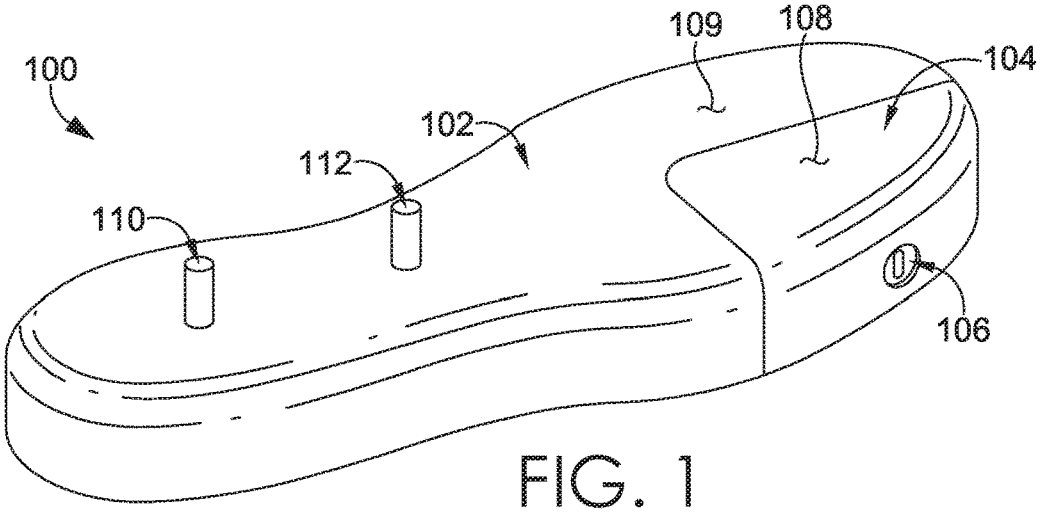
FIG. 1 depicts a footwear component manufacturing fixture, in accordance with aspects hereof.

Aspects provide for a fixture configured to maintain a footwear bottom unit, such as a sole structure that may be comprised of a midsole, an outsole, or a combination thereof, in a fixed position relative to the fixture. By securing the bottom unit to the fixture, the fixture can be moved or positioned as needed to allow for one or more processes to be performed on the bottom unit. Specifically, the fixture may be positioned proximate a foot-facing surface of the bottom unit allowing for a ground-contacting surface and/or sidewall surfaces to be exposed for one or more manufacturing processes to be performed. For example, a laser siping machine may apply laser energy to the ground-contacting surface of the bottom unit to form sipes for tread-like structures. Because the fixture is positioned on a foot-facing surface of the bottom unit, the laser siping process may be performed on the ground contacting surface and a sidewall surface of the bottom unit without repositioning the bottom unit relative to the fixture.

Therefore, in an exemplary aspect, the fixture has a general shoe-like profile at a component-facing surface in one or more of the X-Y plane (e.g., toe-to-heel and medial-to-lateral plane) and vertical contour (curvature and vertical shaping extending from the X-Y plane). This shape mimicking allows for sufficient contact between the fixture and the bottom unit such that support and stability is provided by the fixture to ensure consistent results when processes are performed on the bottom unit as secured by the fixture. Therefore, it is contemplated that the fixture, as will be discussed in greater detail with FIG. 9 hereinafter, has a toe region, a midfoot region, and a heel region that mimic a plan view of a bottom unit to be maintained by the fixture. The toe region has a greater traverse width than the midfoot and heel regions. The heel region has a greater traverse width than the midfoot region, in an exemplary aspect but not always. In alternative aspects it is contemplated that the fixture does not mimic a plan profile or vertical contour of the bottom unit to be maintained, but instead is configured to provide support in a selected region relative to the bottom unit without contacting the bottom unit in other locations. For example, if a process will only be performed in a toe region of the bottom unit, the fixture may mimic a general shape of the bottom unit in the toe region and may take any configuration or even be omitted in a heel region of the bottom unit. As such, it is contemplated that the fixture may have a shaping that mates with the bottom unit in a manner to provide support and stability during a process being performed on the bottom unit.

The fixture, in an exemplary aspect, compresses one or more protrusions extending from the bottom unit to maintain the bottom unit relative to the fixture. For example, it is contemplated that the bottom unit has one or more integrally formed protrusions extending from a foot-facing surface. The protrusion(s) may not typically be integrally formed and extend from a foot-facing surface as they consume additional materials and extend outwardly from a surface traditionally maintained protrusion free to avoid affecting a user's perception of the bottom unit when worn. The one or more protrusions extending from the bottom unit, in an exemplary aspect, are compressed between a fixed portion and an adjustable portion of the fixture. For example, an adjustment mechanism, such as a screw-like element may moveably position the adjustable portion relative to the fixed portion to grasp and maintain the one or more protrusions between the adjustable portion and the fixed portion of the fixture.

Aspects hereof provide a footwear component manufacturing fixture and the use thereof. The fixture is comprised of a fixed portion having a first compression surface and an adjustable portion having a second compression surface. The adjustable portion is moveably coupled to the fixed portion between at least a maintaining position and a receiving position. The first compression surface is closer in proximity to the second compression surface in the maintaining position than when in the receiving position. The fixture is further comprised of an adjustment mechanisms extending between the fixed portion and the adjustable portion. The adjustment mechanism provides, in part, the moveably coupling between the fixed portion and the adjustable portion.

Additional aspects contemplate a method of processing the footwear component, such as the bottom unit, on the fixture. The method includes inserting a first protrusion of the footwear component between a first compression surface of the fixed portion of the fixture and a second compression surface of the adjustable portion of the fixture. The first protrusion extends from a foot-facing surface of the footwear component. The method also includes slidably moving the adjustable portion toward the fixed portion such that the first compression surface and the second compression surface contact the first protrusion allowing the fixture to maintain the footwear component relative to the fixture. After maintaining the footwear component, processing the footwear component as maintained by the fixture; and subsequent to processing the footwear component, slidably moving the adjustable portion away from the fixed portion such that the first compression surface and the second compression disengage the first protrusion. The method may also include removing the first protrusion from between the first compression surface and the second compression surface to disengage the footwear component from the fixture.

FIG. 1 depicts a footwear component manufacturing fixture, fixture 100, in accordance with aspects hereof. The fixture 100 is comprised of a fixed portion 102, an adjustable portion 104, an adjustment mechanism 106, a first component-contacting surface 109, a second component-contacting surface 108, a first maintaining member 110, and a second maintaining member 112. While a specific arrangement, relative location, number, and shape of the various elements is depicted, it is contemplated that any arrangement, relative location, number, and/or shape of the elements may be implemented. For example, the maintaining member(s) may be of any size, shape, position, arrangement, and number. Similarly, the fixture as a whole may be of any shape, size, and/or configuration, as will be depicted in FIGS. 7-9, for example. Similarly, the adjustable portion may be any size, shape, and relative location to the fixed portion to achieve aspects provided herein.

The fixture 100 may be formed from any material, such as a metallic material (e.g., aluminum, steel), polymer-based material (e.g., high-density polyethylene, low-density polyethylene, polypropylene, polystyrene, polyvinylchloride), and the like. One or more portions of the fixture 100 may be formed from different materials. For example, the maintaining members 110, 112 may be formed from a different material than the fixed portion 102 and/or the adjustable portion 104.

The fixture 100, as depicted, has a general plan profile mimicking that of a bottom unit plan. For example, a toe region is wider than a midfoot and heel region. The heel region is wider than the midfoot region, in an exemplary aspect. A longitudinal length (e.g., toe end to heel end) of the fixture 100 may vary depending on a size of bottom unit to be maintained. For example, a shoe size in the longitudinal direction may range from 10 centimeters ("cm") to 40 cm (or larger). Therefore, it is contemplated that the longitudinal length of the fixture 100 may have a similar range, such as between 10 cm and 40 cm, in some aspects. However, it is contemplated that the length may be smaller than 10 cm or greater than 40 cm in alternative aspects. A width of the fixture 100 may also coordinate with a width of bottom unit to be maintained thereon. Width, as used herein, is a traversal measure (e.g., medial to lateral) of the fixture 100. It is contemplated that the fixture may have a width at a widest part (e.g., heelward end of the toe region, which may be referred to as a ball width) ranging from 8 cm to 14 cm, in an exemplary aspect. However, it is contemplated that a width of the fixture may be less than 8 cm or greater than 14 cm at the widest traversal location. As such, it is contemplated that the midfoot region at its narrowest location width may be less than either of the heel region or the toe region at their widest width. As used herein, the width of the toe region contemplates the fixed portion and the adjustable portion in a contacting relationship (e.g., compressing surfaces in contact).

Further, it is contemplated that the fixture has a contour in the vertical direction that corresponds with for mating a foot-facing surface and the fixture. This contour alignment mirroring allows for the fixture to provide stability to the bottom unit as one or more processes are performed on the bottom unit. This stability and support allows for consistent processing results as the bottom unit is securely maintained by the fixture having corresponding contours and shaping.

The fixed portion 102 may be secured to one or more devices to manipulate or maintain the position of the fixture 100. For example, it is contemplated that the fixed portion 102 is secured to a multi-axis movement mechanism (e.g., robotic arm) to move the fixture 100 having a bottom unit maintained thereon relative to one or more manufacturing devices/machines allowing the bottom unit to be processed by the devices/machines. Further, it is contemplated that one or more of the maintaining members 110, 112 are positioned on the fixed portion 102 such that a footwear component is maintained in a known relative location to the fixed portion 102. And consequently a known relative location between the component and a movement device coupled to the fixture maintaining the component regardless of the position of the adjustment mechanism or adjustable portion. The fixed portion 102 may therefore serve as a known logical position from which a location on the footwear component may be translated for one or more processes to be performed.

In an exemplary aspect, the fixed portion 102 forms greater than 50% of the fixture 100 component-contacting surface. In another exemplary aspect, the fixed portion 102 forms greater than 66% of the fixture 100 component-contacting surface. In yet another exemplary aspect, the fixed portion 102 forms greater than 75% of the fixture 100 component-contacting surface.

Figure 8:
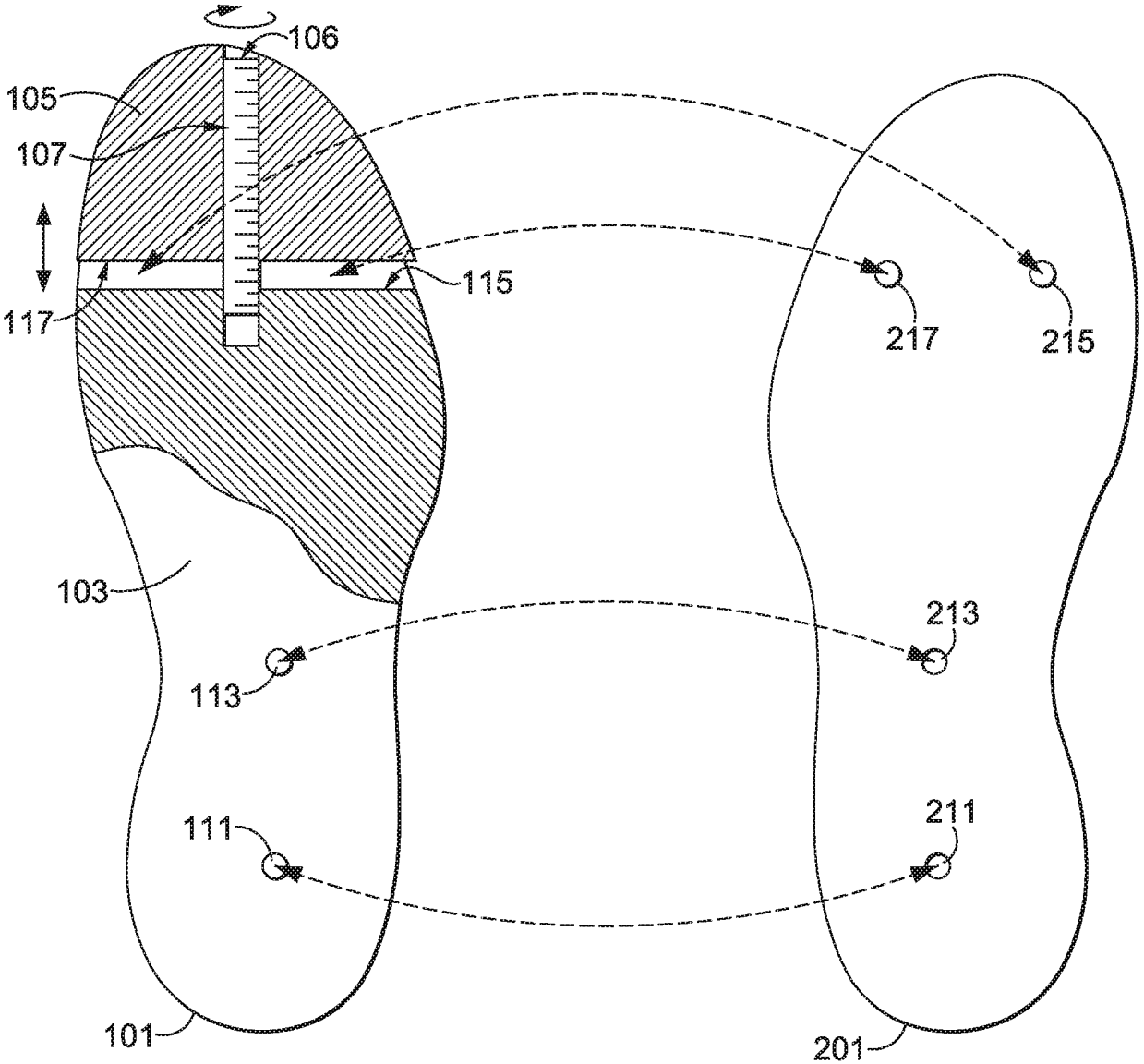
FIG. 8 depicts a plan view of an alternative fixture and a component having a coordinating configuration of receiving members, protrusions, and/or maintaining members, in accordance with aspects hereof.

From an alternative perspective, the fixed portion 102 forms the heel and midfoot regions, as depicted in FIG. 1, for example. Further to this example, the fixed portion 102 also forms at least a portion of the toe region at the component-contacting surface, in an exemplary aspect. However, it is contemplated that the fixed portion 102 may not form the component-contacting surface at one or more locations, such as at the toe end (e.g., as depicted in FIG. 8 hereinafter).

The adjustable portion 104 moves relative to the fixed portion 102. This relative movement allows for the compression of one or more maintaining member between the adjustable portion 104 and the fixed portion 102. The adjustable portion 104 may be at any location in different aspects. However, it is contemplated that the footwear component that is to be maintained on the fixture is configured to have an appropriately positioned protrusion based on the relative location of where the adjustable portion and the fixed portion converge. As depicted in FIG. 1, the adjustable portion forms a lateral portion of the toe region; however, the adjustable portion may form any portion (e.g., a medial portion of the toe region, a lateral portion of the longitudinal length of the fixture, a medial portion of the longitudinal length of the fixture, a toe end portion, a heel end portion, a medial portion of the heel region, a lateral portion of the heel region, a medial portion of the midfoot region, and/or a lateral portion of the midfoot region).

In combination, it is contemplated that the fixed portion 102 and the adjustable portion are suitable to support and maintain a shoe sole from a foot-facing surface. Therefore, the combination is contemplated as having a sole-like shape, in an exemplary aspect.

Figure 6:
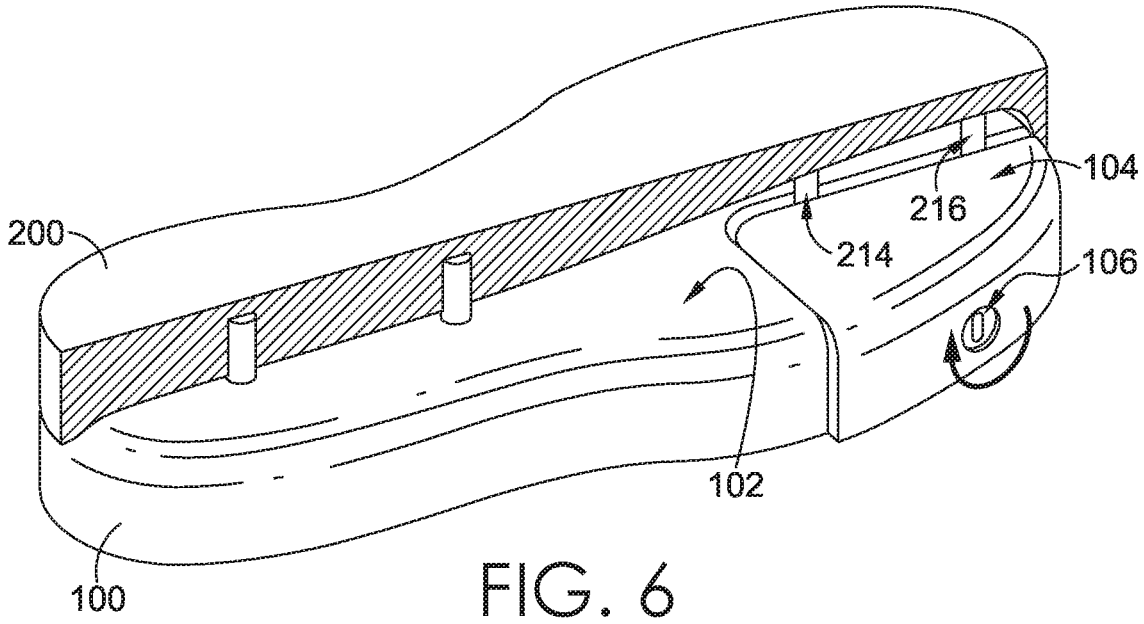
FIG. 6 depicts the fixture of FIG. 1 in the maintaining position such that the protrusions of the footwear component of FIG. 3 are compressed between the fixed portion and the adjustable portion, in accordance with aspects hereof.

The adjustment mechanism 106 positions and maintains the adjustable portion 104 in a maintaining position (e.g., as depicted in FIG. 6 hereinafter) such that when a compressive force is applied between the fixed portion 102 and the adjustable portion 104 on a protrusion of the bottom unit, the compression is maintained to secure the bottom unit relative to the fixture 100. A depicted configuration of the movement mechanism is a threaded element extending through the adjustable portion 104 into the fixed portion 102. It is contemplated that a rotational movement of the adjustment mechanism 106 is translated into a sliding movement of the adjustable portion 104 relative to the fixed portion 102, in an example. It is contemplated that the adjustable portion 104 moves along the length of the adjustment mechanism 106, in an exemplary aspect as the adjustment mechanism 106 is rotated. Alternatively, it is contemplated that the adjustable portion 104 remains in a fixed position relative to the adjustment mechanism 106 while the adjustment mechanism 106 slides relative to the fixed portion 102, in an exemplary aspect. Stated differently, a rotation of the adjustment mechanism 106 may slide the adjustable portion 104 along a length of the adjustment mechanism 106 or the adjustment mechanism 106 slides relative to the fixed portion 102 as the adjustment mechanism 106 is drawn in or out of the fixed portion 102.

Alternative configurations are contemplated for the movement mechanism. For example, a ribbed-like structure having a latch-like structure engaging the ribbed-like structure to maintain a compression between the fixed portion 102 and the adjustable portion 104. Alternatively yet, a friction lock engaging one or more rod or strip elements is contemplated to maintain the compressive force between the fixed portion 102 and the adjustable portion 104. Further yet, a pneumatic and/or hydraulic-powered mechanism may be used. For example, a cylinder containing a piston may be secured to the fixed portion 102 and the adjustable portion 104 to allow for the slidable movement of the portions relative to one another. The movement mechanism may be automated and controlled by one or more computing devices.

The adjustment mechanism, as depicted in FIG. 1, is moveably coupled with both of the fixed portion 102 and the adjustable portion 104. However, it is contemplated that the adjustment mechanism may be fixedly coupled to one of the fixed portion 102 or the adjustable portion 104 while being moveably coupled to the alternative portion, in an exemplary aspect.

Figure 9:
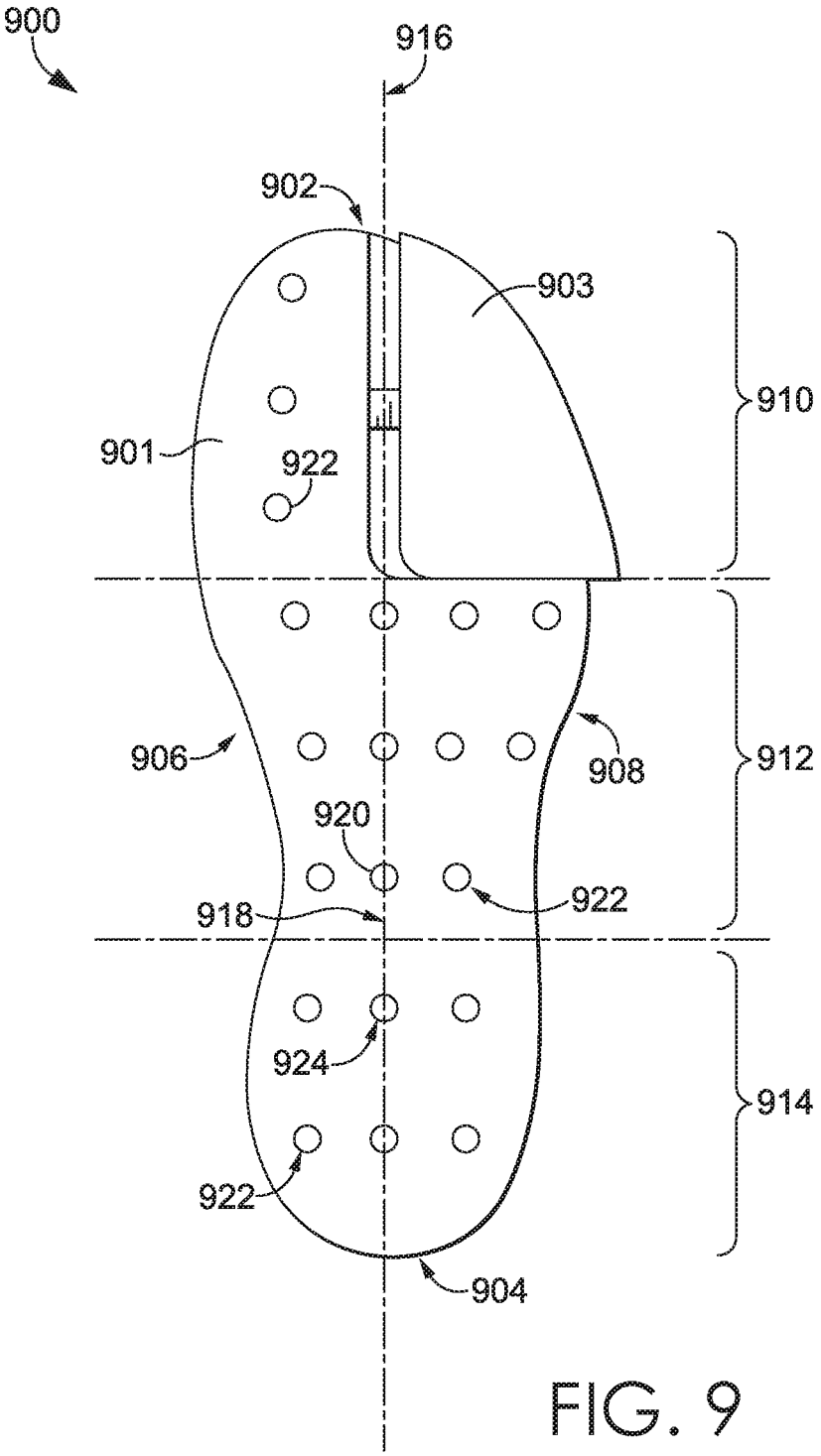
FIG. 9 depicts a plan view of an exemplary fixture, in accordance with aspects hereof.

The maintaining members 110, 112 are depicted as protrusion elements extending from the first component-contacting surface 109 of the fixed portion 102. A maintaining mechanism may be of any shape, such as cylindrical, cubical, and the like. Further, they may be of any size. For example, they may have a width (e.g., diameter) of a pin (e.g., 0.5 millimeters) to 5 cm; however, it is contemplated they have a width greater than 5 cm in an exemplary aspect. A maintaining mechanism may be of any length. For example, they may have a length of 1 cm to 10 cm, in an exemplary aspect. Further yet, it is contemplated that a maintaining member may either be a protrusion as depicted in FIG. 1 or as an aperture having similar sizes and adapted to receive a protrusion from the bottom unit, in this example. The maintaining members of FIG. 9 provided hereinafter may be either protrusions or apertures, in exemplary aspects.

Lastly, as depicted in FIG. 1, the first component-contacting surface 109 is level with the second component-contacting surface 108 at their intersection. This forms a consistent surface to interface with the footwear component to be maintained. Ensuring a level configuration may be achieved through the use of one or more alignment guides (e.g., rod-like elements extending between the fixed portion 102 and the adjustable portion 104 that allow for the slideable movement of one or more of the portions while providing positional support as the two portions slidably interact).

As previously provided, it is contemplated that elements depicted in connection with FIG. 1 may be modified while achieving aspect provided herein. For example, additional or fewer maintaining members may be provided. Alternative size, shape and positioning of the maintaining member may be used in additional aspects. Similarly, different configurations (e.g., size, shape, positions) of the adjustable portion and the adjustment mechanism are also contemplated.

Figure 2:
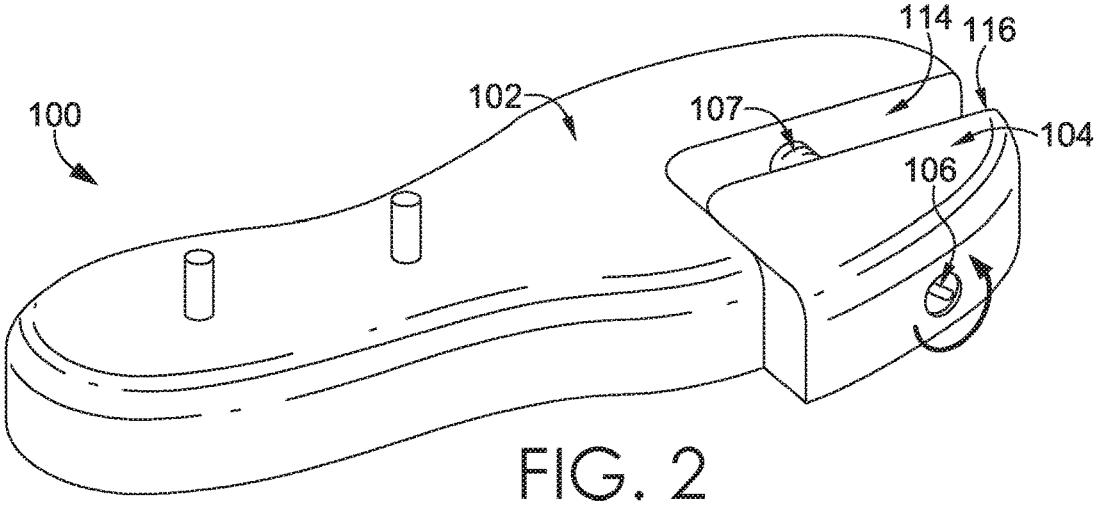
FIG. 2 depicts the fixture of FIG. 1 in a receiving position, in accordance with aspects hereof.

FIG. 2 depicts the fixture 100 in a receiving position, in accordance with aspects hereof. Specifically a gap is depicted between a first compression surface 114 of the fixed portion 102 and a second compression surface 116 of the adjustable portion 104 as the surfaces are traversely offset. The compression surfaces may be formed from the same material as their respective fixed portion or adjustable portion. Alternatively, it is contemplated that a secondary material, such as a material having a higher coefficient of friction relative to the protrusions, may be utilized with one or more compression surfaces. A textured or smooth surface may be formed on one or more portions of a compression surface. A threaded portion 107 of the adjustment mechanism 106 is provided. The threaded portion 107 rotatably engages with the fixed portion 102 and/or the adjustable portion 104 to cause the slideable movement of the adjustable portion 104 relative to the fixed portion 102.

Figure 3:
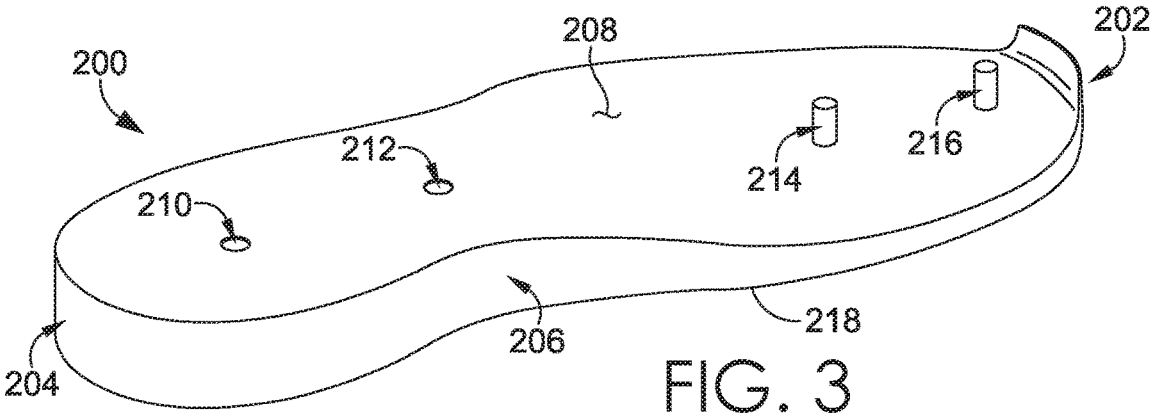
FIG. 3 depicts an exemplary footwear component, in accordance with aspects hereof.

FIG. 3 depicts an exemplary footwear component 200, in accordance with aspects hereof. The component 200 may be a bottom unit, such as a shoe sole. The shoe sole may be an outsole, midsole, or combination thereof, in an exemplary aspect. The component 200 is comprised of a toe end 202, a heel end 204, a medial side 206, a lateral side, a foot-facing surface 208, a ground-contacting surface 218, receiving member 210, 212, and protrusions 214, 216. It is appreciated that any size, shape, style, arrangement, and configuration of component may be substituted for the component 200 in exemplary aspects. For example, as will be depicted in FIG. 9 hereinafter, the protrusions and/or receiving members may be in any combination, location, orientation, number, shape, and/or size. While two longitudinally aligned protrusions 214, 216 are depicted in FIG. 3, alternative arrangements may be implemented, such as that shown in FIG. 8 hereinafter. Similarly, while two receiving members 210, 212 are depicted in a longitudinal alignment with the component 200, it is contemplated that they may be traversely offset from one another or even the longitudinal axis of the component 200, in exemplary aspects.

The foot-facing surface 208 is a superior surface of the component 200 when in an as-worn configuration. For example, the foot-facing surface 208 may serve as a footbed onto which a user places his/her foot, such as a sandal slide. Alternatively, the foot-facing surface is a surface coupled (e.g., adhered, stitched, bonded) with a strobel layer used when forming a shoe upper about a cobbler's last. Further yet, it is contemplated that one or more layers (e.g., sock-liner/insole, midsole) may be disposed between the foot-facing surface 208 and a user's foot when worn.

Traditionally a protrusion-like element may not be integrally formed on the foot-facing surface 208 as it may cause discomfort to a wearer and use excessive material. However, it is contemplated in an exemplary aspect, that during the formation of the component 200, one or more protrusions are integrally formed to extend from the foot-facing surface 208, such as protrusions 214, 216 in this example. The component 200 may be made from a variety of materials, such as a polymer-based material (e.g., ethylene-vinyl acetate (EVA), polyurethane (PU), expanded thermo polyurethane (eTPU)). A mold for forming the component 200 may include one or more structures to integrally form the protrusions and/or receiving members allowing for those features to be integrally formed during the formation of the component 200, in an exemplary aspect. Alternatively, it is contemplated that one or more post-production operations (e.g., milling, adhering, mechanically inserting) may be performed on a footwear component to form the protrusion(s) and/or receiving member(s).

The ground-contacting surface 218 is a surface of the component 200 intended to face the ground when worn. It is contemplated that one or more layers may be positioned between the ground-contacting surface 218 and the actual ground when in use. For example one or more elements may be adhered to the ground-contacting surface to enhance abrasion resistance, traction, aesthetics, and the like of the component 200. Further, it is contemplated that one or more processes may be performed on the ground-contacting surface 218. As such, the protrusions 214, 216 extend from the opposite foot-facing surface 208 so the fixture 100, when secured to the component 200, does not obscure the ground-contacting surface 218 from one or more machines/device to perform the operations. Similarly, the protrusions 214, 216 extend from the foot-facing surface 208 so the fixture 100, when secured to the component 200, does not obscure the sidewalls extending between the ground-contacting surface 218 and the foot-facing surface 208 (e.g., the sidewalls form the medial side 206, the heel end 204, the toe end 202, and the lateral side). By not obscuring the sidewalls and the ground-contacting surface 218, the fixture 100 allows for a seamless transition between performing operations on both types of surfaces without having to change fixtures or positions relative to the fixture as both types of processes are performed.

The protrusions extending from the component 200 may be of any shape, such as cylindrical, cubical, and the like. Further, they may be of any size. For example, they may have a width (e.g., diameter) of a pin (e.g., 0.5 millimeters) to 5 cm; however, it is contemplated they have a width greater than 5 cm in an exemplary aspect. A protrusion may be of any length. For example, they may have a length of 1 cm to 10 cm, in an exemplary aspect. For example, it is contemplated that the protrusions 214, 216 have a diameter between 0.5 cm and 2 cm and a height extending from the foot-facing surface 208 from 0.5 cm to 5 cm.

The receiving members extending into the component 200 may be of any shape, such as cylindrical, cubical, and the like. Further, they may be of any size. For example, they may have a width (e.g., diameter) of a pin (e.g., 0.5 millimeters) to 5 cm; however, it is contemplated they have a width greater than 5 cm in an exemplary aspect. A receiving member may be of any length. For example, they may have a length of 1 cm to 10 cm, in an exemplary aspect. For example, it is contemplated that the receiving members 210, 212 have a diameter between 0.5 cm and 2 cm and a height extending into the component 200 from the foot-facing surface 208 from 0.5 cm to 5 cm. A receiving member may be formed during a molding process. For example, a receiving member may be a structure used during an injection molding formation of the bottom unit, such as from the use of a curing pin. A curing pin drives thermal energy into portions of a molded article to facilitate even curing of the article that may have variations in material thickness and/or shape. Therefore, the receiving members may be remnants from the use of curing pins during a molding operation. Consequently, corresponding maintaining members on the fixture may be positioned on the fixture in locations that allows those maintaining members to be received in the receiving members formed by curing pins, in an exemplary aspect.

As previously provided, it is contemplated that any number, size, configuration, and arrangement of protrusions and/or receiving members may be implemented in connection with a component in exemplary aspects.

Figure 4:
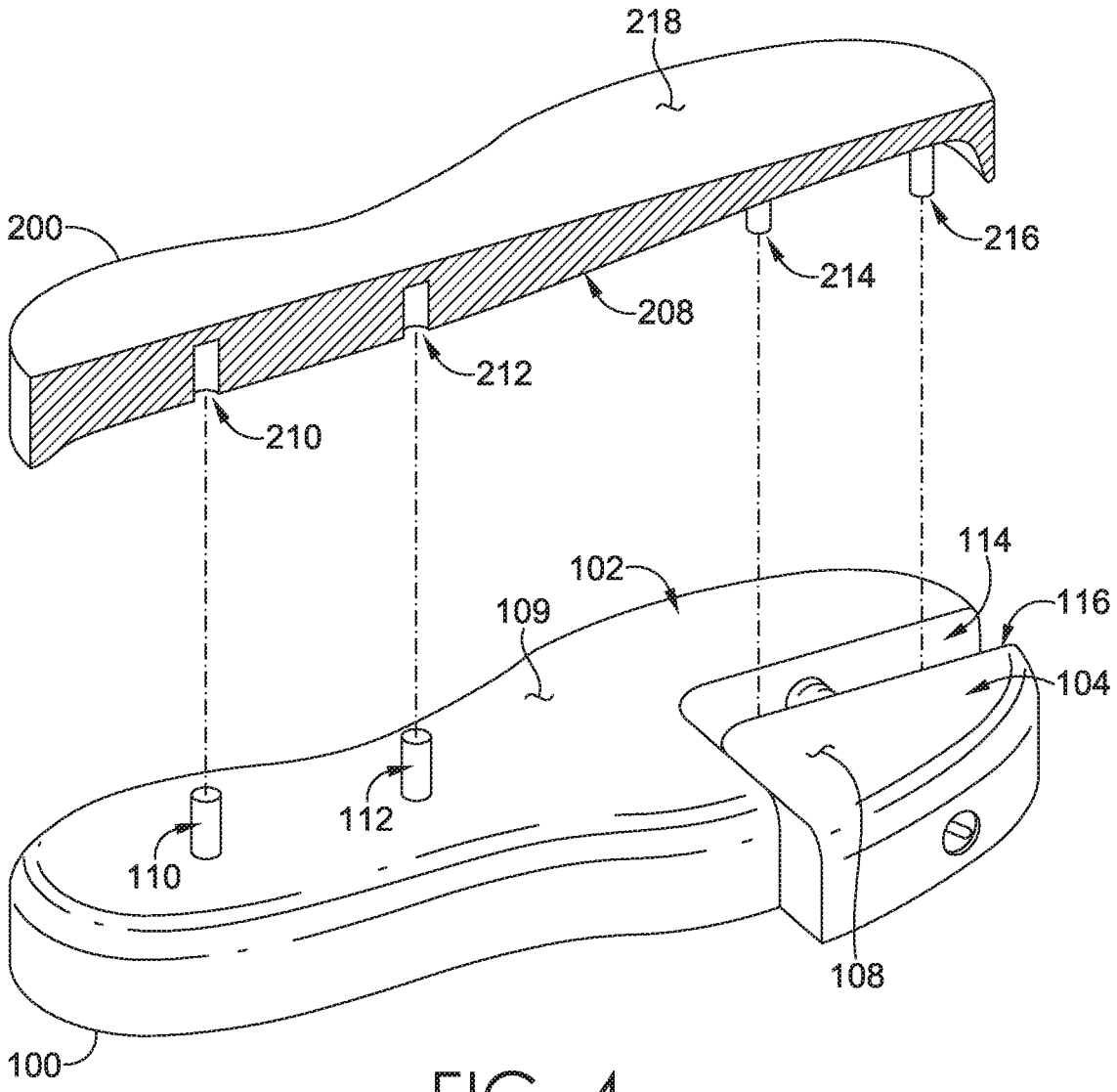
FIG. 4 depicts the fixture of FIG. 1 having the fixed portion and the adjustable portion in a receiving position, in accordance with aspects hereof.
Figure 5:
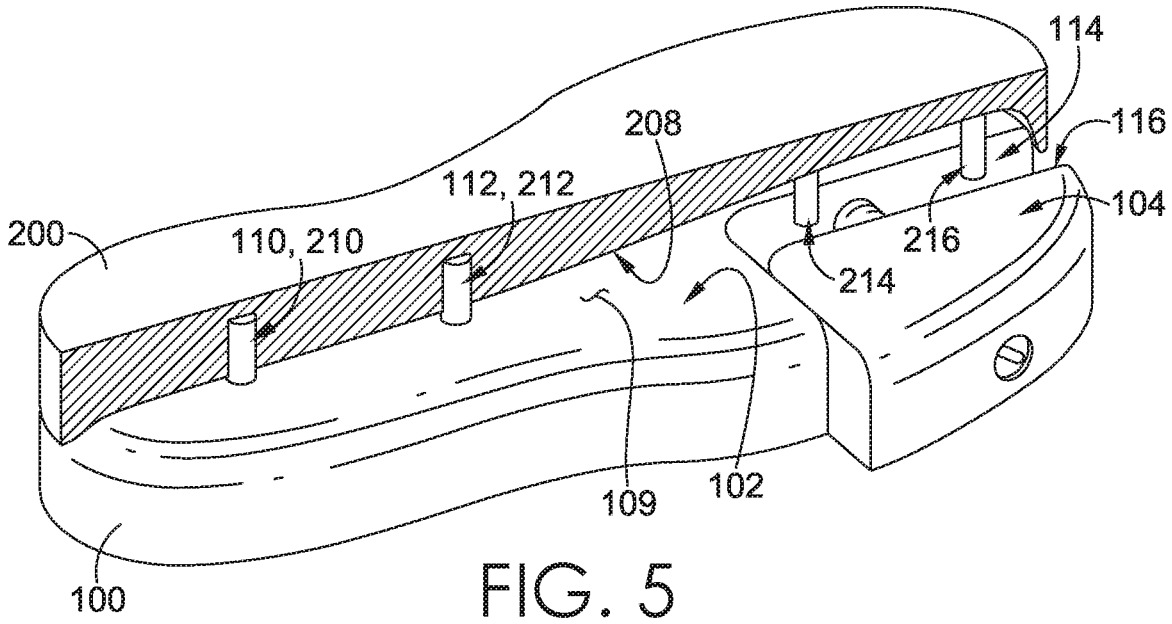
FIG. 5 depicts the foot-facing surface of the component of FIG. 3 in communication with the component-facing surface of the FIG. 1 fixture, in accordance with aspects hereof.

FIGS. 4-6 depicts a series of steps for securing the component 200 of FIG. 3 with the fixture 100 of FIGS. 1 and 2, in accordance with aspects hereof. FIG. 4 depicts the fixture 100 having the fixed portion 102 and the adjustable portion 104 in a receiving position that forms a gap between the first compression surface 114 and the second compression surface 116 for receiving the protrusions 214, 216, in accordance with aspects hereof. FIG. 5 depicts the foot-facing surface 208 of the component 200 in communication with the component-contacting surface 109 of the fixture 100, in accordance with aspects hereof. As depicted in FIG. 5, the maintaining members 110, 112 are received and frictionally engaged with the receiving members 210, 212, respectively. The protrusions 214, 216 are received between the compression surfaces 114, 116. In an exemplary configuration, the protrusions 214, 216 are positioned on the component 200 such that when the maintaining members 110, 112 are received and frictionally engaged with the receiving members 210, 212, and the protrusions 214, 216 are positioned proximate (e.g., contacting or within 5 millimeters) the first compression surface 114. A distance from the second compression surface 116 may vary as the adjustable portion 104 transitions between the maintaining position and the receiving position. FIG. 6 depicts the fixture 100 in the maintaining position such that the protrusions 214, 216 are compressed between the fixed portion 102 and the adjustable portion 104, in accordance with aspects hereof.

Figure 7:
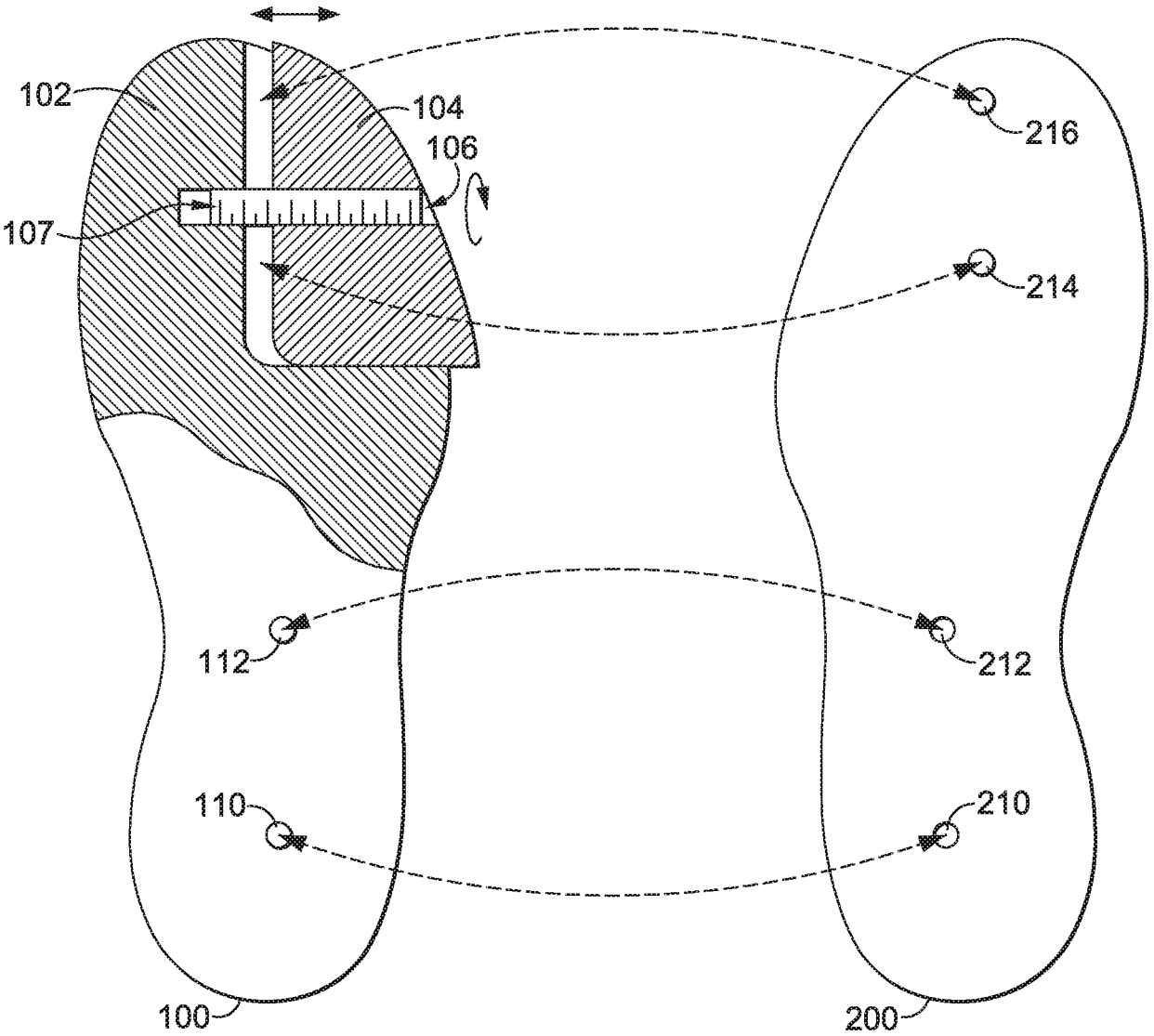
FIG. 7 depicts a plan view of a fixture and a component having a coordinating configuration of receiving members, protrusions, and/or maintaining members, in accordance with aspects hereof.

FIG. 7 depicts a plan view of the fixture 100 and the component 200 having a coordinating configuration of receiving members, protrusions, and/or maintaining members, in accordance with aspects hereof. FIG. 8 depicts a plan view of an alternative fixture 101 and a component 201, in accordance with aspects hereof. In this example of FIG. 8, the fixture 101 is configured with an adjustable portion 105 longitudinally moveable relative to the fixture 101. The adjustable portion 105 forms at least a part of the toe region and specifically the toe end. A fixed portion 103 extends from the toe region to the heel end. A first compression surface 115 and a second compression surface 117 extend across a traversal width of the fixture 101. This arrangement in FIG. 8 provides for a perpendicular movement of the adjustable portion as compared to the configuration of FIG. 7. Because of the traversal extension of the compressions surface 115, 117 in FIG. 8, the component 201 is configured with traversely offset protrusions 215, 217. Elements 111, 113 of the fixture 101 are maintaining members that may either be protrusions or apertures, in an exemplary aspect. The elements 211, 213 are correspondingly configured as receiving members or protrusions, depending on the configuration of elements 111, 113.

FIG. 9 depicts a plan view of an exemplary fixture 900, in accordance with aspects hereof. The fixture 900 has a toe end 902, a heel end 904, a medial side 906, a lateral side 908, a toe region 910, a midfoot region 912, a heel region 914, a longitudinal axis 916, a maintaining member axis 918 extending between two maintaining members 920, 924, and a plurality of other maintaining members 922, in accordance with aspects hereof. The longitudinal axis 916 extends from the toe end 902 to the heel end 904. The toe region 910 is comprised of a toe-end apex of the medial side 906, the midfoot region 912 is comprised of a nadir of the medial side 906, and the heel region 914 is comprised of a heel-end apex of the medial side 906.

The plurality of maintaining members 922 may be protrusions and/or apertures, in exemplary aspects. The relationship of the plurality of maintaining members 922 may include longitudinal alignment that is parallel with the longitudinal axis 916, such as illustrated by the maintaining member axis 918 extending between the maintaining members 920, 924. Alternatively and/or additionally, the maintaining members may be traversely offset from one another and, in an exemplary aspect, traversely positioned relative to the longitudinal axis 916. As depicted, any number of maintaining member may form the plurality of maintaining members 922. Further, the maintaining members may be positioned in any regions of the fixture.

Figure 10:
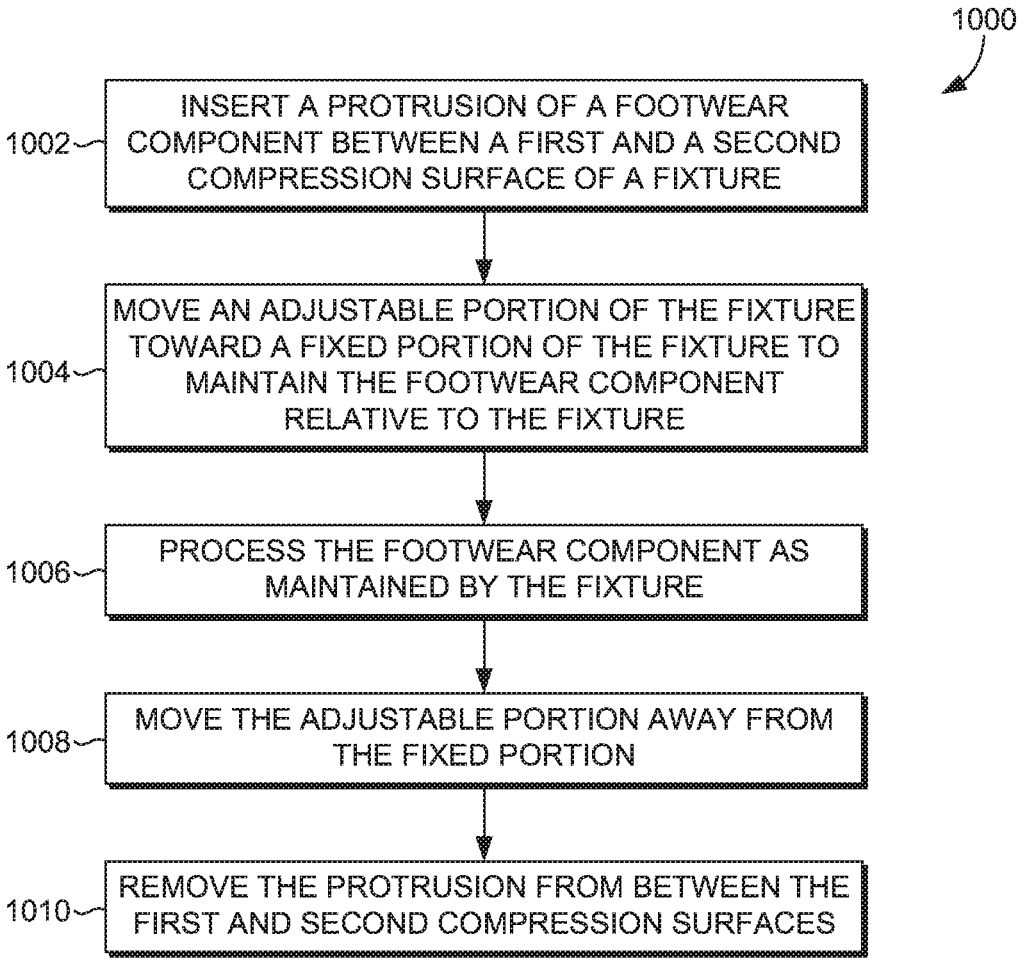
FIG. 10 depicts a flow chart representing a method of processing a footwear component on a fixture, in accordance with aspects hereof.

FIG. 10 depicts a flow chart 1000 representing a method of processing a footwear component on a fixture, in accordance with aspects hereof. At a block 1002, a protrusion of a footwear component is inserted between a first and a second compression surface of a fixture. In an exemplary aspect, the protrusion extends from a foot-facing surface of the component. Additionally, in an exemplary aspect, the first compression surface is a surface of a fixed portion of the fixture and the second compression surface is a surface of an adjustable portion of the fixture.

At a block 1004, the adjustable portion of the fixture is moved toward the fixed portion of the fixture to maintain the footwear component relative to the fixture. For example, the movement of the adjustable portion may compress the protrusions of the footwear component between the fixed portion and the adjustable portion such that a frictional engagement there between limits the movement of the component relative to the fixture. The movement of the adjustable portion may be caused by a rotational force of an adjustment mechanism being translated into a linear motion of the adjustable portion to slidably move relative to the fixed portion.

At a block 1006, the footwear component is processed. For example, the fixture maintaining the footwear component may be positioned relative to a machine that performs an operation on the footwear component. Because the fixture is a known size and shape relative to the fixed portion, a movement mechanism can position the fixture, and therefore the footwear component secured thereto, at a known location for an operation to be performed. For example, if a series of laser-formed sipes are to be formed into the footwear component, the footwear component can be moved relative to the laser energy source to achieve a defined siping pattern, in an exemplary aspect.

At a block 1008, the adjustable portion may be moved away from the fixed portion to a receiving position that allows for the removal of the protrusions between the first and second compression surfaces, as provided at a block 1010.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

While specific elements and steps are discussed in connection to one another, it is understood that any element and/or steps provided herein is contemplated as being combinable with any other elements and/or steps regardless of explicit provision of the same while still being within the scope provided herein. Since many possible embodiments may be made of the disclosure without departing from the scope thereof, it is to be understood that all matter herein set forth or shown in the accompanying drawings is to be interpreted as illustrative and not in a limiting sense.

The invention claimed is:

1. A footwear component manufacturing fixture, comprising:

a fixed portion having a first compression surface, wherein the fixed portion comprises a first maintaining member, and wherein the first maintaining member comprises a protrusion extending away from a component-facing surface;

an adjustable portion having a second compression surface, the adjustable portion moveably coupled to the fixed portion between at least a maintaining position to maintain a footwear component relative to the footwear component manufacturing fixture and a receiving position, wherein the first compression surface is closer in proximity to the second compression surface in the maintaining position than when in the receiving position; and an adjustment mechanism, the adjustment mechanism extending between the fixed portion and the adjustable portion, wherein the adjustment mechanism provides, in part, the moveable coupling between the fixed portion and the adjustable portion.

2. The footwear component manufacturing fixture of claim 1, wherein the first maintaining member is positioned in one of:

a heel region of the footwear component manufacturing fixture, a midfoot region of the footwear component manufacturing fixture, or a toe region of the footwear component manufacturing fixture.

3. The footwear component manufacturing fixture of claim 1, further comprising a second maintaining member.

4. The footwear component manufacturing fixture of claim 3, wherein the second maintaining member is one of a protrusion extending from the component-facing surface or an aperture extending into the component-facing surface.

5. The footwear component manufacturing fixture of claim 3, wherein the first maintaining member is positioned in a heel region and the second maintaining member is positioned in a midfoot region of the fixed portion.

6. The footwear component manufacturing fixture of claim 3, wherein an axis extending between the first maintaining member and the second maintaining member is parallel with a longitudinal axis of the footwear component manufacturing fixture.

7. The footwear component manufacturing fixture of claim 3, wherein the second maintaining member is traversely offset from the first maintaining member.

8. The footwear component manufacturing fixture of claim 1, wherein the adjustable portion forms a portion of a toe region of the footwear component manufacturing fixture.

9. The footwear component manufacturing fixture of claim 1, wherein the adjustable portion is traversely moveable relative to the fixed portion.

10. The footwear component manufacturing fixture of claim 1, wherein the adjustable portion is longitudinally moveable relative to the fixed portion.

11. The footwear component manufacturing fixture of claim 1, wherein the first compression surface and the second compression surface are parallel surfaces.

12. The footwear component manufacturing fixture of claim 1, wherein the first compression surface extends in a direction parallel with a longitudinal axis of the footwear component manufacturing fixture.

13. The footwear component manufacturing fixture of claim 1, wherein the fixed portion has a first component-contacting surface and the adjustable portion has a second component-contacting surface, such that when in the maintaining position, the first component-contacting surface proximate the first compression surface and the second component-contacting surface proximate the second compression surface are level.

14. The footwear component manufacturing fixture of claim 1, wherein the adjustment mechanism is comprised of a threaded surface engaged by at least one of the fixed portion or the adjustable portion, such that a rotational movement of the adjustment mechanism provides adjustable movement between at least the maintaining position and the receiving position.

15. The footwear component manufacturing fixture of claim 1, wherein the adjustable portion has an adjustment aperture extending traversely there through, and wherein the adjustment mechanism extends through the adjustment aperture.

16. The footwear component manufacturing fixture of claim 1, wherein the adjustment mechanism is comprised of a ribbed surface engaged by at least one of the fixed portion or the adjustable portion, such that a linear movement of the adjustment mechanism releasably maintains the adjustable portion in the maintaining position.

* * * * *